US009568168B2

(12) United States Patent
Nakamura

(10) Patent No.: US 9,568,168 B2
(45) Date of Patent: Feb. 14, 2017

(54) LIGHT FLUX CONTROLLING MEMBER, LIGHT EMITTING DEVICE AND ILLUMINATION APPARATUS

(71) Applicant: Enplas Corporation, Saitama (JP)

(72) Inventor: Masato Nakamura, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 130 days.

(21) Appl. No.: 14/433,390

(22) PCT Filed: Sep. 11, 2013

(86) PCT No.: PCT/JP2013/005361

§ 371 (c)(1),
(2) Date: Apr. 3, 2015

(87) PCT Pub. No.: WO2014/054226

PCT Pub. Date: Apr. 10, 2014

(65) Prior Publication Data

US 2015/0247621 A1 Sep. 3, 2015

(30) Foreign Application Priority Data

Oct. 5, 2012 (JP) ..... 2012-223224

(51) Int. Cl.
*F21V 5/00* (2015.01)
*F21V 13/04* (2006.01)
(Continued)

(52) U.S. Cl.
CPC ..... *F21V 13/04* (2013.01); *F21K 9/232* (2016.08); *F21K 9/60* (2016.08); *F21V 5/008* (2013.01);
(Continued)

(58) Field of Classification Search
CPC ..... F21V 13/04; F21V 5/008; F21V 5/043; F21V 5/045; F21V 7/0016; F21K 9/232; F21K 9/60
See application file for complete search history.

(56) References Cited

U.S. PATENT DOCUMENTS 4,652,979 A * 3/1987 Arima ..... F21S 48/2212 362/268
7,588,351 B2 * 9/2009 Meyer ..... F21V 3/02 362/235
(Continued)

FOREIGN PATENT DOCUMENTS

CN 202469675 U 10/2012
GB 2267332 * 12/1993 ..... F21V 5/00
(Continued)

OTHER PUBLICATIONS

Extended European Search Report dated Apr. 22, 2016 for Eurpean Application No. 13844039.1.
International Search Report from International Application No. PCT/JP13/005361 mailed Nov. 19, 2013.

*Primary Examiner* — Peggy Neils
(74) *Attorney, Agent, or Firm* — Brundidge & Stanger, P.C.

(57) ABSTRACT

Light flux control member has first light flux control member and second light flux control member facing first light flux control member. First light flux control member and second light flux control member both have central axes which coincide with optical axis of a light emitting element. In inclined Fresnel lens of first light flux control member, the distance from troughs between annular projections to lower side step in optical axis direction is small for outer troughs, and gradually increases for troughs closer to optical axis. According to the present invention, a light flux control member which, from among the front, side, and rear, is
(Continued)

capable of balanced distribution of light in at least two of those directions, a light emitting device, and an illumination device can be provided.

4 Claims, 18 Drawing Sheets

(51) Int. Cl.
*F21V 5/04* (2006.01)
*F21V 7/00* (2006.01)
*F21Y 101/00* (2016.01)

(52) U.S. Cl.
CPC ..... *F21V 5/043* (2013.01); *F21V 5/045* (2013.01); *F21V 7/0016* (2013.01); *F21Y 2101/00* (2013.01)

(56) References Cited

U.S. PATENT DOCUMENTS

| | | | |
|---|---|---|---|
| 2007/0147041 | A1 | 6/2007 | Shiratsuchi et al. |
| 2012/0063146 | A1 | 3/2012 | Kawagoe et al. |
| 2013/0114254 | A1 | 5/2013 | Nakamura |

FOREIGN PATENT DOCUMENTS

| | | | |
|---|---|---|---|
| JP | 2003-258319 | A | 9/2003 |
| JP | 2011-175978 | A | 9/2011 |
| JP | 2012-048950 | A | 3/2012 |
| JP | 2012-185949 | A | 9/2012 |
| WO | 2011/080767 | A1 | 7/2011 |
| WO | 2012/005008 | A1 | 1/2012 |

* cited by examiner

LIGHT FLUX CONTROLLING MEMBER, LIGHT EMITTING DEVICE AND ILLUMINATION APPARATUS

TECHNICAL FIELD

The present invention relates to a light flux controlling member for controlling a distribution of light emitted from a light emitting element, and a light emitting device and an illumination apparatus having the light flux controlling member.

BACKGROUND ART

In recent years, in view of energy saving and environmental conservation, illumination apparatuses using light-emitting diodes (hereinafter also referred to as "LED") as light sources, (such as LED bulbs), have been used in place of incandescent lamps. However, the conventional illumination apparatuses using LED as a light source emit light only forward, and cannot emit light in a wide range direction unlike incandescent lamps. Therefore, the conventional illumination apparatuses cannot extensively illuminate a room by using reflected light from the ceiling or the walls unlike incandescent lamps.

To bring the light distribution characteristics of the conventional illumination apparatus using an LED as a light source close to those of incandescent lamps, it is suggested to control the distribution of light emitted from the LED with a light flux controlling member (see, e.g., PTL 1). FIG. 1 is a sectional view of a main portion illustrating the configuration of an illumination apparatus disclosed in PTL 1. As illustrated in FIG. 1, illumination apparatus 10 includes a plurality of LEDs 12 disposed on a substrate, and cylindrical case 14 made of optically transparent material disposed around LEDs 12. The top surface of case 14 is formed to have an inverted truncated cone shape.

Aluminum plate 16 that reflects light is attached to the oblique surface of the truncated cone, and serves as a reflection surface. On the other hand, the planar surface of the truncated cone serves as transmission window 18 that transmits light. As indicated by arrows in FIG. 1, a part of light emitted from LEDs 12 passes through transmission window 18 to be emitted forward (upward direction). Further, a part of the light emitted from LED 12 is reflected by aluminum plate 16 to be emitted sideward (horizontal direction) and backward (downward direction).

The control of the traveling direction of light emitted from the LEDs using a light flux controlling member in this manner makes it possible to obtain emitted light not only forward, but also sideward and backward. Accordingly, the use of the light flux controlling member (reflection surface) disclosed in PTL 1 makes it possible to bring the light distribution characteristics of the illumination apparatus (LED bulb) close to those of incandescent lamps to a certain extent.

CITATION LIST

Patent Literature

PTL 1
Japanese Patent Application Laid-Open No. 2003-258319

SUMMARY OF INVENTION

Technical Problem

However, the illumination apparatus disclosed in PTL 1 has the problem of ill-balanced light distribution characteristics. When illumination apparatus 10 disclosed in PTL 1 is used, only light emitted from LEDs 12 reaches space A in front of the upper end of case 14, as illustrated in FIG. 1. On the other hand, not only light emitted from LEDs 12 but also light reflected from aluminum plate 16 reaches space B behind the upper end of case 14. Therefore, space A and space B undesirably have different brightness. Accordingly, when illumination apparatus 10 disclosed in PTL 1 is covered with cover 20, the amount of light reaching portion A of cover 20 undesirably greatly differs from the amount of light reaching portion B of cover 20, as illustrated in FIG. 2. Therefore, a boundary of bright and dark may occur on cover 20.

An object of the present invention is to provide a light flux controlling member that is used for an illumination apparatus including a light emitting element and that can distribute light in at least two directions of forward, sideward and backward in a well-balanced manner. In addition, another object of the present invention is to provide a light emitting device and an illumination apparatus having the light flux controlling member.

Solution to Problem

A light flux controlling member according to the present invention is a light flux controlling member for controlling a distribution of light emitted from at least one light emitting element, the light flux controlling member including: a first light flux controlling member disposed to face the light emitting element; and a second light flux controlling member that is disposed to face the first light flux controlling member, wherein:

the first light flux controlling member includes a Fresnel lens part that has a plurality of rotationally symmetrical annular projections about an optical axis of the light emitting element as a rotation axis and faces the light emitting element, and an emission surface that faces the second light flux controlling member to emit light controlled by the Fresnel lens part toward the second light flux controlling member, each of the annular projections has an inner first inclining surface configured to receive a part of the light emitted from the light emitting element, and an outer second inclining surface for reflecting a part of the light having entered the first inclining surface toward the second light flux controlling member, the second light flux controlling member includes a reflection surface that faces the emission surface of the first light flux controlling member to reflect a part of light emitted from the first light flux controlling member and reached the second light flux controlling member, and to transmit a rest of the light, the reflection surface is a rotationally symmetrical plane about the optical axis as a rotation axis, the rotationally symmetrical plane having a generatrix line that is a concave curve relative to the first light flux controlling member, an outer peripheral portion of the reflection surface is located at a position distant from the light emitting element in a direction of the optical axis compared with a center portion of the reflection surface, and the Fresnel lens part includes an inclining Fresnel lens part at which a distance in the direction of the optical axis from a valley formed between the adjacent annular projections to a mounting surface on which the light emitting element is to be mounted is gradually increased toward the optical axis away from an outside.

A light emitting device according to the present invention includes at least one light emitting element, and the light flux controlling member according to the present invention.

An illumination apparatus of the present invention includes the light emitting device according to the present invention, and a cover for transmitting light emitted from the light emitting device while diffusing the emitted light.

Advantageous Effects of Invention

The light flux controlling member of the present invention can distribute light in at least two directions of forward, sideward and backward in a well-balanced manner. Accordingly, the light emitting device of the present invention is capable of emitting light extensively, and the illumination apparatus of the present invention is capable of extensively illuminating a room like an incandescent lamp.

DESCRIPTION OF EMBODIMENTS

Hereinafter, embodiments of the present invention will be described in detail with reference to the accompanying drawings. The following description explains an illumination apparatus which may be used in place of incandescent lamps, as a typical example of the illumination apparatus according to the present invention.

[Configuration of Illumination Apparatus]

Figure 1:
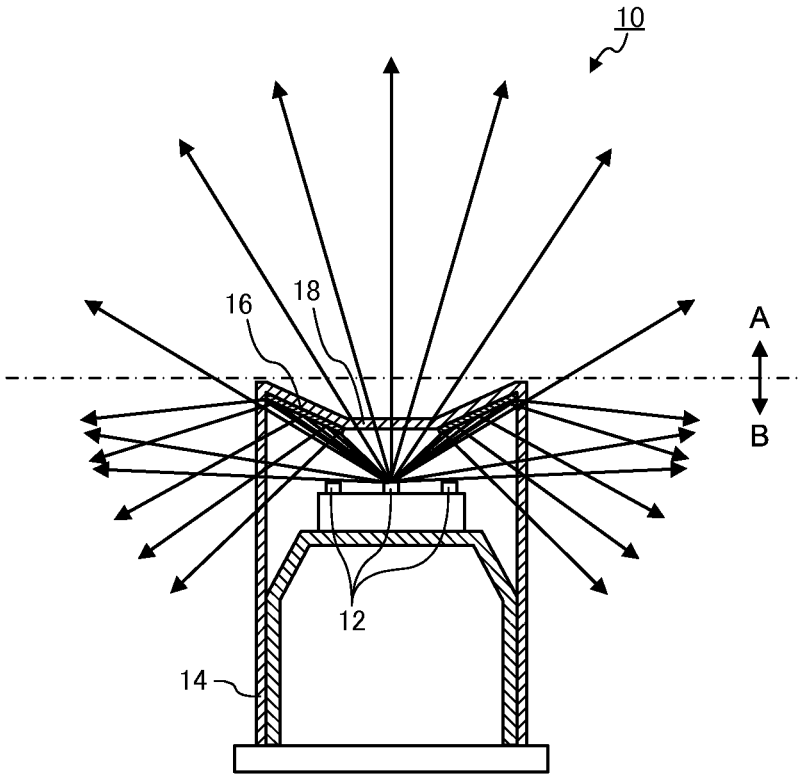
FIG. 1 is a sectional view of a main portion illustrating the configuration of an illumination apparatus disclosed in PTL 1.
Figure 2:
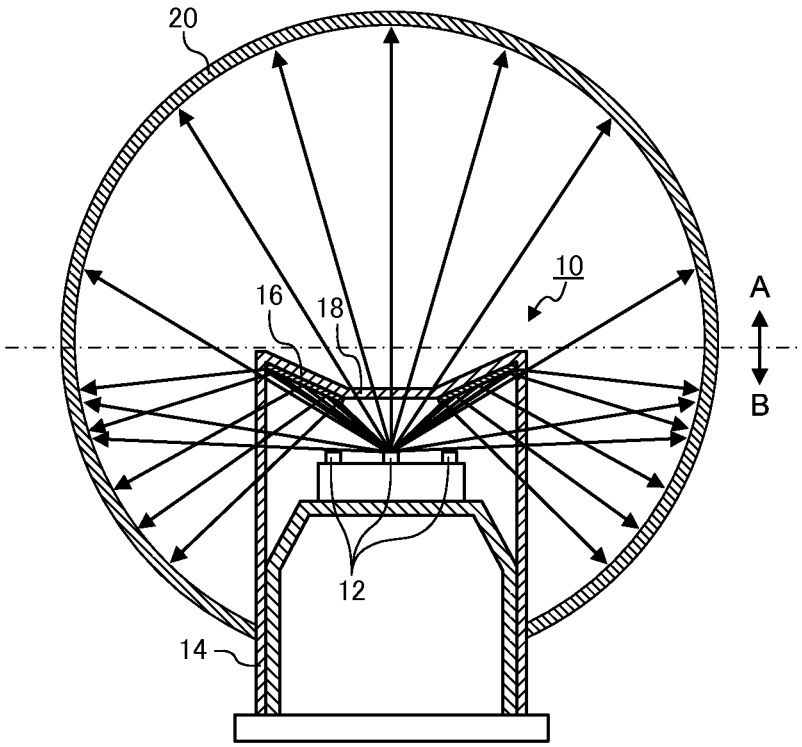
FIG. 2 is a sectional view of a main portion of the illumination apparatus disclosed in PTL 1 with a cover provided.
Figure 3:
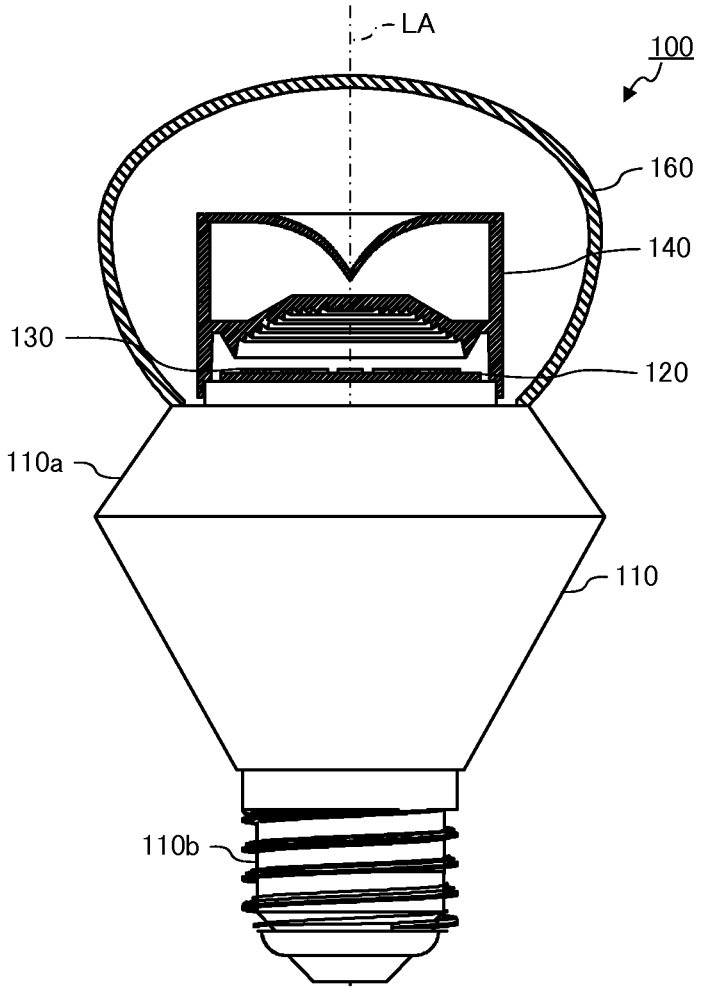
FIG. 3 is a partially sectional view of an illumination apparatus according to Embodiment 1 of the present invention.

FIG. 3 is a partially sectional view of illumination apparatus 100 according to Embodiment 1 of the present invention. As illustrated in FIG. 3, illumination apparatus 100 includes casing 110, substrate 120, light emitting element 130, light flux controlling member 140 and cover 160. Hereinafter, each component will be described.

(1) Casing, and Substrate

Casing 110 has inclining surface 110*a* that inclines from the edge of a step portion at the outside of one end surface of casing 110 toward the other end of casing 110, and base 110*b* disposed at the other end of casing 110. Casing 110 also serves as a heat sink for releasing heat from light emitting element 130. Inside base 110*b* and the heat sink, a power circuit (not illustrated) electrically connecting base 110*b* and light emitting element 130 is provided.

Inclining surface 110*a* is formed so as not to shield light emitted backward through cover 160. Substrate 120 is disposed on one end surface of casing 110. The shape of substrate 120 is not particularly limited as long as light emitting element 130 can be mounted on substrate 120, and does not need to be a plate-like shape.

(2) Light Emitting Element

Light emitting element 130 is a light source of illumination apparatus 100 and is mounted on the surface of substrate 120 fixed on casing 110. The surface of substrate 120 corresponds to a mounting surface for light emitting element 130. Light emitting element 130 is disposed on substrate 120 such that optical axis LA of light emitting element 130 is along the normal line to substrate 120. For example, light emitting element 130 is a light-emitting diode (LED) such as a white light-emitting diode.

Figure 4:
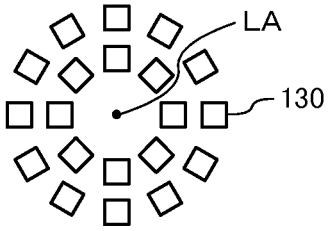
FIG. 4 is a plan view illustrating the disposition of light emitting elements in the illumination apparatus according to Embodiment 1.

The term "optical axis of light emitting element" means the traveling direction of light in the center of a three-dimensional light flux from the light emitting element. When there are a plurality of light emitting elements, the term means the traveling direction of light in the center of three-dimensional light fluxes from the plurality of light emitting elements. FIG. 4 is a drawing in plan view illustrating the disposition of light emitting elements 130. For example, as illustrated in FIG. 4, a plurality of light emitting elements are disposed point-symmetrically with respect to optical axis LA when viewed in plan view.

(3) Light Flux Controlling Member

Figure 5:
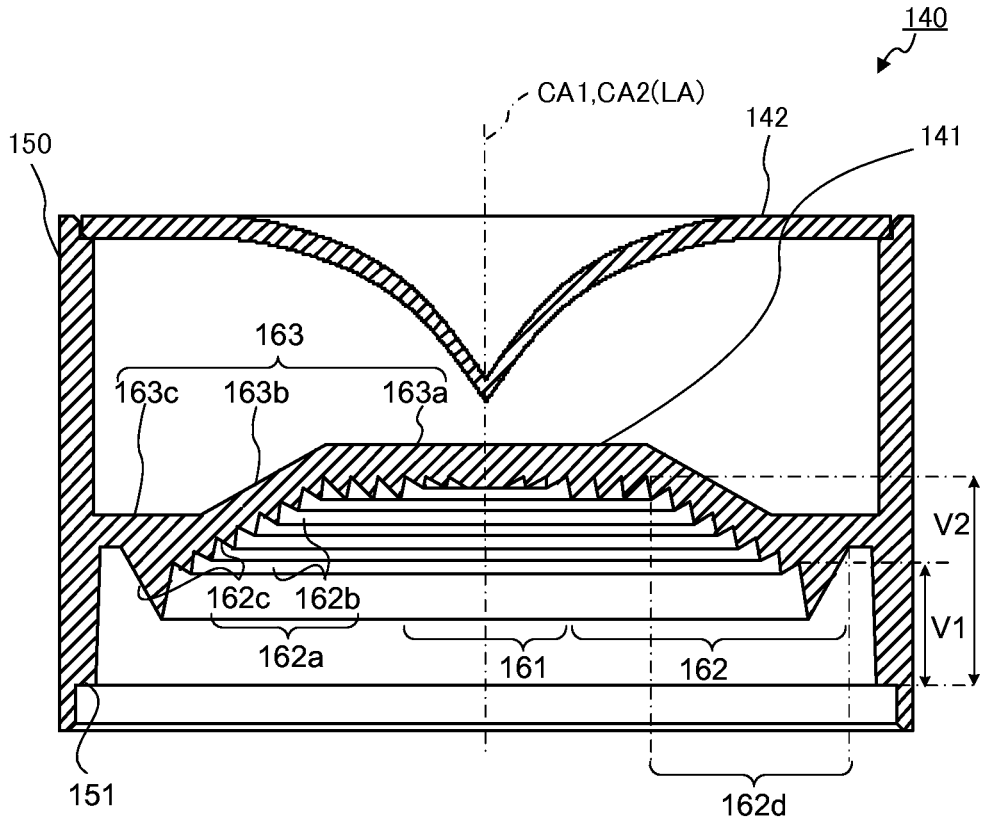
FIG. 5 is a sectional view of a light flux controlling member according to Embodiment 1.

FIG. 5 is a sectional view of light flux controlling member 140. Light flux controlling member 140 controls the distribution of light emitted from light emitting element 130. As illustrated in FIG. 5, light flux controlling member 140 includes first light flux controlling member 141 disposed to face light emitting element 130, second light flux controlling member 142 disposed to face first light flux controlling member 141 and holder 150.

(3-1) First Light Flux Controlling Member

Figure 6A:
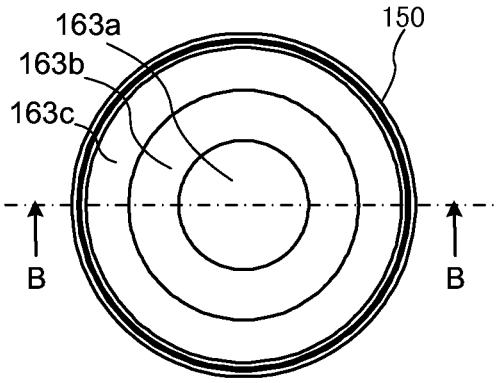
FIG. 6A is a plan view of a first light flux controlling member and a holder of the light flux controlling member according to Embodiment 1.
Figure 6B:
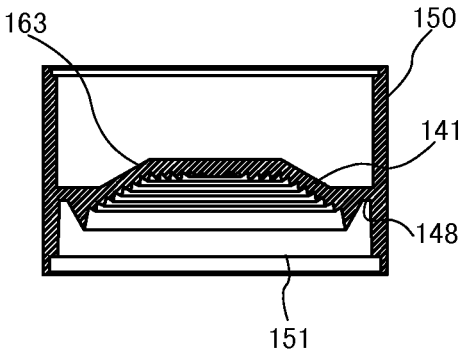
FIG. 6B is a sectional view of the first light flux controlling member and the holder taken along line B-B illustrated in FIG. 6A.
Figure 6D:
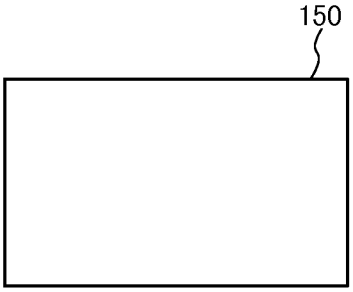
FIG. 6D is a side view of the first light flux controlling member and the holder.
Figure 6C:
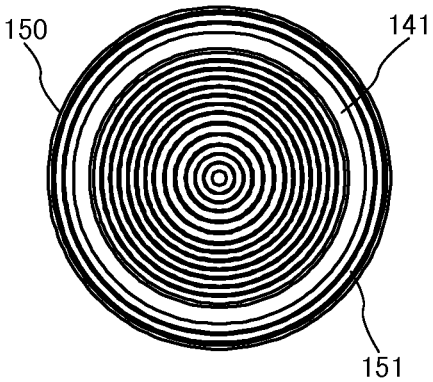
FIG. 6C is a bottom view of the first light flux controlling member and the holder.

FIGS. 6A to 6D are drawings illustrating the configuration of first light flux controlling member 141 and holder 150. FIG. 6A is a plan view of first light flux controlling member 141 and holder 150, FIG. 6B is a sectional view of first light flux controlling member 141 and holder 150 taken along line B-B illustrated in FIG. 6A, FIG. 6C is a bottom view of first light flux controlling member 141 and holder 150, and FIG. 6D is a side view of first light flux controlling member 141 and holder 150.

First light flux controlling member 141 controls the traveling direction of a part of light emitted from light emitting element 130. First light flux controlling member 141 functions such that the distribution of light emitted from first light flux controlling member 141 becomes narrower than the distribution of light emitted from light emitting element 130. As illustrated in FIG. 6A, first light flux controlling member 141 is formed to have a substantially circular shape in plan view. First light flux controlling member 141 is integrally formed with holder 150, and is disposed with an air layer interposed between light emitting element 130 and first light flux controlling member 141 such that its central axis CA1 coincides with optical axis LA of light emitting element 130 (see FIG. 5).

As illustrated in FIG. 5, first light flux controlling member 141 has refraction part 161, Fresnel lens part 162, and emission surface 163. When emission surface 163 side is set as the front side of first light flux controlling member 141, refraction part 161 is formed at the center portion on the rear side surface of first light flux controlling member 141.

The shape of refraction part 161 is a rotationally symmetrical shape (circular shape) about central axis CA1 as a central axis. The refraction part may be formed, for example, of a planar, spherical, aspherical or refractive Fresnel lens, or of a combination thereof. Refraction part 161 is composed of a circular part positioned at the center on the rear side surface of first light flux controlling member 141, and of several small annular projections 162*a* that surround the periphery of the circular part. The center of annular projection 162*a* coincides with central axis CA1.

Fresnel lens part 162 is formed annularly to surround refraction part 161 when viewed in plan view. Fresnel lens part 162 has a plurality of annular projections 162*a* of which centers are positioned on optical axis LA. Annular projection 162*a* is larger than annular projection 162*a* included in refraction part 161. Annular projection 162*a* has inner first inclining surface 162*b* and outer second inclining surface 162*c*. As illustrated in FIG. 6B, flange part 148 may be formed between the outer edge of outermost second inclining surface 162*c* and the outer edge of emission surface 163.

First inclining surface 162*b* is a surface running from the top edge of annular projection 162*a* to the bottom edge (valley) inside annular projection 162*a*, and is a rotationally symmetrical plane about central axis CA1 of first light flux controlling member 141. That is, first inclining surfaces 162*b* are formed to have an annular shape about central axis CA1 as a central axis. The inclining angles of first inclining surfaces 162*b* may be different from one another, and there may be a case where the first inclining surfaces are parallel to optical axis LA (inclining angle is 90°). The generatrix line of first inclining surface 162*b* may either be a straight line or a curve.

It is noted that the term "generatrix line" generally means a straight line to draw a ruled surface, but in the present invention, is also used as a term including a curve to draw first inclining surface 162*b* that is a rotationally symmetrical plane. When first inclining surface 162*b* is a curved surface, the inclining angle of first inclining surface 162*b* is an angle of a tangent of first inclining surface 162*b* relative to central axis CA1.

Second inclining surface 162*c* is a surface running from the top edge of annular projection 162*a* to the bottom edge (valley) outside annular projection 162*a*. Second inclining surface 162*c* is a rotationally symmetrical plane formed to surround central axis CA1 of first light flux controlling member 141. The radius of second inclining surface 162*c* (distance from second inclining surface 162*c* to central axis CA1) is gradually increased toward the bottom edge away from the top edge of annular projection 162*a*. The generatrix line forming second inclining surface 162*c* is an arc-shaped curve protruding toward the outside (side away from central axis CA1). Further, depending on light distribution characteristics required for illumination apparatus 100, the generatrix line forming second inclining surface 162*c* may be a straight line. That is, second inclining surface 162*c* may have a tapered shape.

It is noted that the term "generatrix line" generally means a straight line to draw a ruled surface, but in the present invention, is also used as a term including a curve to draw second inclining surface 162*c* that is a rotationally symmetrical plane. The inclining angle of second inclining surface 162*c* may vary for each individual second inclining surface 162*c*. When second inclining surface 162*c* is a curved surface, the inclining angle of second inclining surface 162*c* is an angle of a tangent of second inclining surface 162*c* relative to central axis CA1.

Fresnel lens part 162 includes inclining Fresnel lens part 162*d*. Inclining Fresnel lens part 162*d* is formed of a plurality of annular projections 162*a*. Inclining Fresnel lens part 162*d* is formed such that the distance in the direction of central axis CA1 from a valley formed between adjacent annular projections 162*a* to light emitting element 130 is the shortest at the outermost valley, and is gradually increased toward central axis CA1. For example, in inclining Fresnel lens part 162*d*, distance V1 from the outermost valley to lower step part 151 formed at the lower end edge of holder 150 is the shortest, and distance V2 from a valley that is the closest to central axis CA1 to lower step part 151 is the longest, in the direction of central axis CA1 (see FIG. 5).

Annular projection 162*a* may be formed additionally outside inclining Fresnel lens part 162*d*. The distance from a valley formed by this additional annular projection 162*a* to lower step part 151 is not particularly limited.

It is noted that lower step part 151 is a step formed by cutting out the inner edge of the lower end surface of holder 150. For example, when light flux controlling member 140 is attached to casing 110, lower step part 151 abuts on the edge of one end surface of casing 110 on which substrate 120 is fixed, to be parallel to the surface (mounting surface) of substrate 120 (see FIG. 3).

Lower step part 151 is in such a position with respect to the mounting surface, and thus functions as a part for positioning the mounting surface and first light flux controlling member 141, so that, when comparing the distance in the direction of central axis CA1 from the above-mentioned valley to the mounting surface, the position of lower step part 151 can be employed in place of the position of the mounting surface.

Emission surface 163 is formed on the front side of first light flux controlling member 141. That is, emission surface 163 is formed to face second light flux controlling member 142. Emission surface 163 includes circular emission surface 163*a* formed on the front side of refraction part 161, inclining emission surface 163*b* formed on the front side of inclining Fresnel lens part 162*d*, and annular emission surface 163*c* formed outside inclining emission surface 163*b*.

Circular emission surface 163*a* has a circular shape in plan view, and is formed asa surface of which distance to lower step part 151 in the direction of central axis CA1 is constant. Inclining emission surface 163*b* has an annular shape to surround circular emission surface 163*a* in plan view, and is formed as an oblique surface of which distance to lower step part 151 in the direction of central axis CA1 is gradually decreased away from central axis CA1. Annular emission surface 163*c* has an annular shape to surround inclining emission surface 163*b* in plan view, and is formed as a surface of which distance to lower step part 151 in the direction of central axis CA1 is constant.

First light flux controlling member 141 is formed by injection molding, for example. The material for first light flux controlling member 141 is not particularly limited as long as the material has such higher transparency as to transmit light of a desired wavelength. Examples of the material for first light flux controlling member 141 include optically transparent resins such as polymethylmethacrylate (PMMA), polycarbonate (PC) and epoxy resin (EP), and glass.

Refraction part 161 and first inclining surface 162*b* allows a part of light emitted from light emitting element 130 to enter first light flux controlling member 141. Refraction part 161 receives a part of light emitted from light emitting element 130 and refracts the part of light toward emission surface 163. Thus, refraction part 161 functions as an incidence surface of light entering first light flux controlling member 141.

First inclining surface 162*b* receives light emitted from light emitting element 130. Thus, first inclining surface 162*b* functions as an incidence surface of light entering first light flux controlling member 141. Second inclining surface 162*c* totally reflects a part of the light having entered first inclining surface 162*b* toward second light flux controlling member 142. Thus, second inclining surface 162*c* functions as a total reflection surface that totally reflects a part of the light incident from first inclining surface 162*b*. That is, Fresnel lens part 162 functions as a reflection type Fresnel lens.

Emission surface 163 emits a part of the light incident from refraction part 161 and first inclining surface 162*b* and the light totally reflected at second inclining surface 162*c* toward second light flux controlling member 142.

(3-2) Second Light Flux Controlling Member

Figure 7A:
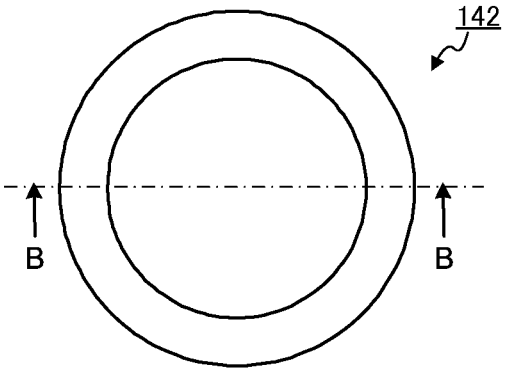
FIG. 7A is a plan view of a second light flux controlling member of the light flux controlling member according to Embodiment 1.
Figure 7B:
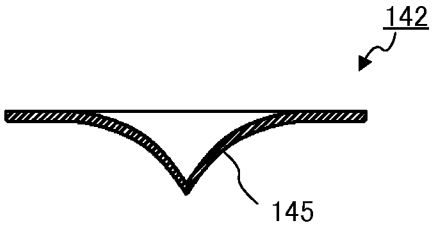
FIG. 7B is a sectional view of the second light flux controlling member taken along line B-B illustrated in FIG. 7A.
Figure 7D:
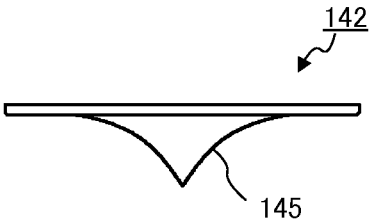
FIG. 7D is a side view of the second light flux controlling member.
Figure 7C:
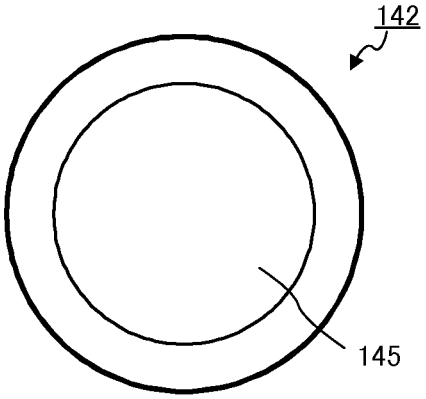
FIG. 7C is a bottom view of the second light flux controlling member.

FIGS. 7A to 7D are drawings illustrating the configuration of second light flux controlling member 142. FIG. 7A is a plan view of second light flux controlling member 142, FIG. 7B is a sectional view of second light flux controlling member 142 taken along line B-B illustrated in FIG. 7A, FIG. 7C is a bottom view of second light flux controlling member 142, and FIG. 7D is a side view of second light flux controlling member 142.

As illustrated in FIG. 7A, second light flux controlling member 142 is a member formed to have a substantially circular shape when viewed in plan view. Second light flux controlling member 142 is supported by holder 150, and is disposed with an air layer interposed between first light flux controlling member 141 and second light flux controlling member 142 such that its central axis CA2 coincides with optical axis LA of light emitting element 130 (see FIG. 5). Second light flux controlling member 142 has reflection surface 145 that faces first light flux controlling member 141 and reflects a part of light emitted from first light flux controlling member 141.

Reflection surface 145 is a rotationally symmetrical (circularly symmetrical) plane about central axis CA2 of second light flux controlling member 142. Thus, the rotation axis of reflection surface 145 coincides with central axis CA2. Further, as illustrated in FIG. 5, the generatrix line from the center of this rotationally symmetrical plane to the outer peripheral portion is a concave curve relative to light emitting element 130 and first light flux controlling member 141, and reflection surface 145 is a curved surface formed by rotating this generatrix line by 360°. That is, reflection surface 145 has an aspherical curved surface of which height from light emitting element 130 is increased toward the outer peripheral portion away from the center.

Further, the outer peripheral portion of reflection surface 145 is formed at a position distant (in height) from light emitting element 130 in the direction of optical axis LA of light emitting element 130 compared with the center of reflection surface 145. For example, reflection surface 145 is an aspherical curved surface of which height from light emitting element 130 is increased toward the outer peripheral portion away from the center, or is an aspherical curved surface of which height from light emitting element 130 (substrate 120) is increased toward the outer peripheral portion away from the center portion between the center portion and a predetermined point, the height from light emitting element 130 is decreased toward the outer peripheral portion away from the center portion between the predetermined point and the outer peripheral portion.

In the former case, the inclining angle of reflection surface 145 relative to the plane direction of substrate 120 becomes smaller toward the outer peripheral portion away from the center. In the latter case, reflection surface 145 has a point at which the inclining angle relative to the plane direction of substrate 120 is zero (parallel to substrate 120) near the outer peripheral portion between the center and the outer peripheral portion.

It is noted that, as described above, the term "generatrix line" generally means a straight line to draw a ruled surface, but in the present invention, is also used as a term including a curve to draw reflection surface 145 that is a rotationally symmetrical plane.

Second light flux controlling member 142 controls the traveling direction of a part of light, having been emitted from first light flux controlling member 141 and having reached second light flux controlling member 142, to reflect the part of the light while transmitting the rest of the light. Reflection surface 145 reflects a part of the light emitted from first light flux controlling member 141 toward holder 150. The reflected light is transmitted through holder 150 to reach the middle portion (side portion) and the lower portion of cover 160.

The means for imparting the functions of the partial reflection and partial transmission described above to second light flux controlling member 142 is not particularly limited. For example, a transmissive/reflective film may be formed on the surface of second light flux controlling member 142 (surface facing light emitting element 130 and first light flux controlling member 141) made of an optically transparent material. Examples of the optically transparent material include transparent resin materials such as polymethylmethacrylate (PMMA), polycarbonate (PC) and epoxy resin (EP), and glass. Examples of the transmissive/reflective film include dielectric multilayer films such as a multilayer film of $TiO_2$ and $SiO_2$, a multilayer film of $ZnO_2$ and $SiO_2$ and a multilayer film of $Ta_2O_5$ and $SiO_2$, and a metallic thin film made of aluminum (Al).

Further, light-scattering elements such as beads may be dispersed into second light flux controlling member 142 made of an optically transparent material. That is, second light flux controlling member 142 may be formed of a material that reflects a part of light and transmits a part of the light.

Further, an optically transparent part may be formed in second light flux controlling member 142 made of an optically reflective material. Examples of the optically reflective material include white resins and metals. Examples of the optically transparent part include a through-hole and a bottomed recess. In the latter case, light emitted from light emitting element 130 and first light flux controlling member 141 is transmitted through the bottom portion (thin portion) of the recess. For example, it is possible to form second light flux controlling member 142 having both functions of optical reflectivity and optical transparency with a light transmittance of visible light of about 20% and a light reflectance of visible light of about 78% by using white polymethylmethacrylate.

It is preferable that a surface (reflection surface 145), which faces first light flux controlling member 141, of second light flux controlling member 142 is formed such that reflection intensity of incident light in a specular reflection direction is greater than reflection intensity in other directions. Therefore, the surface, which faces first light flux controlling member 141, of second light flux controlling member 142 is formed to have a glossy surface.

(3-3) Holder

Holder 150 is positioned at substrate 120, and at the same time positions first light flux controlling member 141 and second light flux controlling member 142 with respect to light emitting element 130.

Holder 150 is an optically transparent member formed to have a substantially cylindrical shape. In the present specification, the "substantially cylindrical shape" includes such a sectionally polygonal tubular shape as to have light distribution characteristics comparable to those of the cylindrical shape. Second light flux controlling member 142 is fixed to one end portion of holder 150. The other end portion of holder 150 is fixed to substrate 120. In the following description, the end portion to which second light flux controlling member 142 is fixed is referred to as "upper end portion," and the end portion which is fixed to substrate 120 is referred to as "lower end portion," out of the two end portions of holder 150.

Holder 150 is formed by integral molding together with first light flux controlling member 141. The material for holder 150 is not particularly limited as long as the material can transmit light of a desired wavelength. Examples of the material for holder 150 include optically transparent resins such as polymethylmethacrylate (PMMA), polycarbonate (PC) and epoxy resin (EP), and glass. To impart a light diffusion capacity of holder 150, a scattering element may be added in these optically transparent materials, or the surface of holder 150 may be subjected to light diffusion treatment.

As illustrated in FIGS. 5 and 6B, on the lower end portion of holder 150, lower step part 151 is formed that abuts on the rim portion of one end surface of casing 110 at the time of attaching light flux controlling member 140 to casing 110 and positions holder 150 with respect to substrate 120.

It is noted that the means for positioning holder 150 with respect to substrate 120 is not particularly limited to lower step part 151. For example, at the lower end portion of holder 150, a boss (convex part) and locking claw may be provided for positioning holder 150 on substrate 120, casing 110, or the like, in place of lower step part 151. The boss abuts on substrate 120 to adjust the height of second light flux controlling member 142. The locking claw locks into a locking hole formed in one end surface of casing 110 or substrate 120 to prevent holder 150 from being disengaged and from rotating.

In addition, holder 150 may further has other means for positioning second light flux controlling member 142 with respect to holder 150. Such a positioning means is not particularly limited. For example, at the upper end portion of holder 150, an upper step part formed by cutting out the inner edge of the upper end surface of holder 150, or a guide projection and a claw part for fixing second light flux controlling member 142 may be provided.

The guide projection is formed at a part of the outer peripheral portion of the end surface of the upper end portion to prevent second light flux controlling member 142 from moving in the radial direction of holder 150. The claw part is formed on the end surface of the upper end portion, and is fitted into the recess formed in the outer peripheral portion of second light flux controlling member 142 to prevent second light flux controlling member 142 from being disengaged and from rotating.

The method for manufacturing light flux controlling member 140 is not particularly limited. For example, light flux controlling member 140 may be manufactured by assembling second light flux controlling member 142 to an integrally molded product of first light flux controlling member 141 and holder 150. When second light flux controlling member 142 is assembled, an adhesive or the like may be used.

The integrally molded product of first light flux controlling member 141 and holder 150 may be produced by injection molding using a colorless transparent resin material, for example. Second light flux controlling member 142 may be produced, for example, by injection molding using a colorless transparent resin material, and then, vapor-deposititing a transmissive/reflective film on a surface to be reflection surface 145, or by injection molding using a white resin material.

It is noted that first light flux controlling member 141 and holder 150 may be molded separately. In this case, first light flux controlling member 141 is assembled to holder 150, and second light flux controlling member 142 is assembled to holder 150, thereby enabling light flux controlling member 140 to be manufactured. Separate molding of first light flux controlling member 141 and holder 150 enhances the freedom in selecting the material for forming holder 150 and first light flux controlling member 141. For example, it becomes easier to form holder 150 with an optically transparent material containing a scattering element, and to form first light flux controlling member 141 with an optically transparent material free from a scattering element.

(4) Cover

Cover 160 transmits light emitted from the light emitting device (light emitted from light flux controlling member 140) while diffusing the emitted light. Cover 160 is a member which has an opening and in which a hollow area is formed. Substrate 120, light emitting element 130 and light flux controlling member 140 are disposed inside the hollow area of cover 160. The means for imparting a light diffusion capacity to cover 160 is not particularly limited. For example, the inner surface or outer surface of cover 160 may be subjected to light diffusion treatment (e.g., roughening), or cover 160 may be produced using a light diffusive material (e.g., an optically transparent material containing a scattering element such as beads).

For example, the front surface or rear surface of cover 160 may either be a smooth surface or a roughened surface. By roughening the front surface or rear surface of cover 160, it becomes possible to reduce illuminance unevenness of illumination apparatus 100.

The shape of cover 160 may be, for example, a spherical crown shape (such a shape that a part of the spherical surface is truncated with a plane), but is not particularly limited.

[Light Distribution Characteristics of Light Emitting Device]

Next, the optical path of light emitted from light emitting element 130 in light flux controlling member 140 will be described. First, the outline of the optical path will be described.

Among the light beams emitted from light emitting element 130, light reaching refraction part 161 enters first light flux controlling member 141 from refraction part 161, and is emitted from emission surface 163 to reach second light flux controlling member 142.

Among the light beams emitted from light emitting device 130, light reaching Fresnel lens part 162 enters first light flux controlling member 141 from first inclining surface 162*b*, and is reflected at second inclining surface 162*c* toward second light flux controlling member 142. Then, the reflected light is emitted from emission surface 163 to reach second first light flux controlling member 142.

A part of the light having reached second light flux controlling member 142 is transmitted through second light flux controlling member 142 to reach the upper portion of cover 160. Further, the rest of the light having reached second light flux controlling member 142 is reflected at reflection surface 145 of second light flux controlling member 142 to reach the middle portion (side portion) and the lower portion of cover 160 through holder 150. At that time, the light reflected at the center portion of second light flux controlling member 142 propagates toward the middle portion of cover 160. The light reflected at the outer peripheral portion of second light flux controlling member 142 propagates toward the lower portion of cover 160.

Light having been emitted from light emitting device 130 and having reached holder 150 is transmitted through holder 150 and is emitted from the outer peripheral surface of holder 150 to reach the middle portion of cover 160. Thus, the light emitted from light emitting element 130 is distributed forward, sideward and backward by light flux controlling member 140.

When a plurality of light emitting elements 130 are disposed on substrate 120, light from light emitting element 130 disposed outermost, out of these light emitting elements 130, does not easily enter the first light flux controlling member, compared with light emitted from other light emitting elements 130. Thus, the optical paths of the light emitted from light emitting element 130 disposed outermost will be described.

Figure 8A:
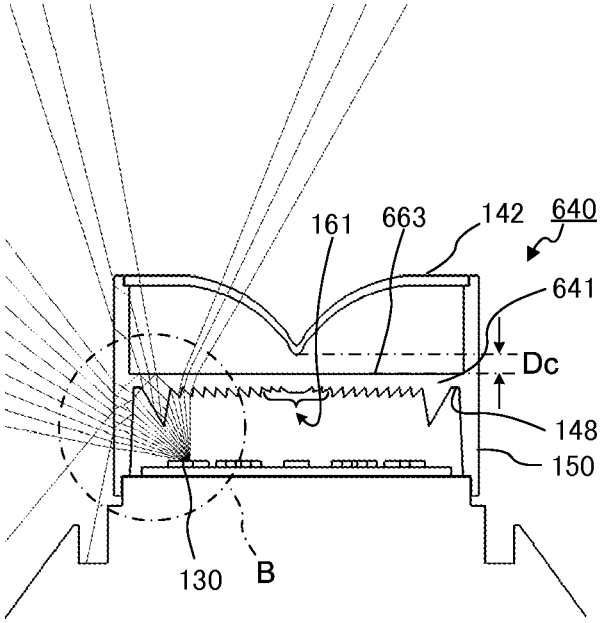
FIG. 8A is a drawing illustrating optical paths of light emitted from a light emitting element disposed outermost when using a light flux controlling member having a substantially tabular first light flux controlling member.
Figure 8B:
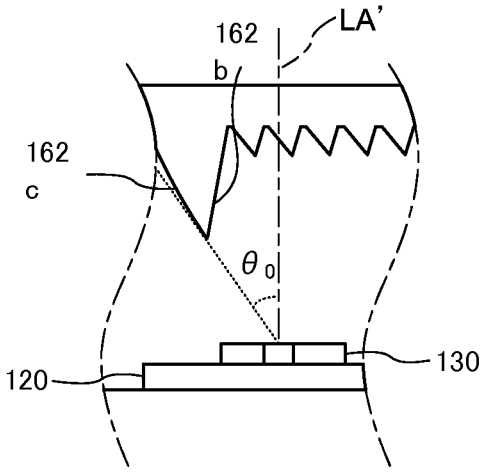
FIG. 8B is an enlarged view of a portion encircled by circle B in FIG. 8A of the light flux controlling member.
Figure 9A:
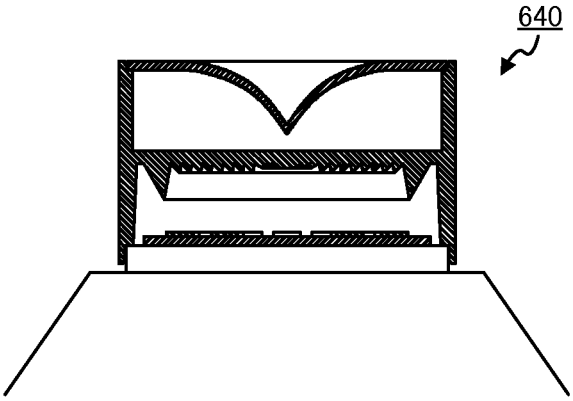
FIG. 9A is a partially sectional view of a light emitting device having the substantially tabular light flux controlling member.
Figure 9B:
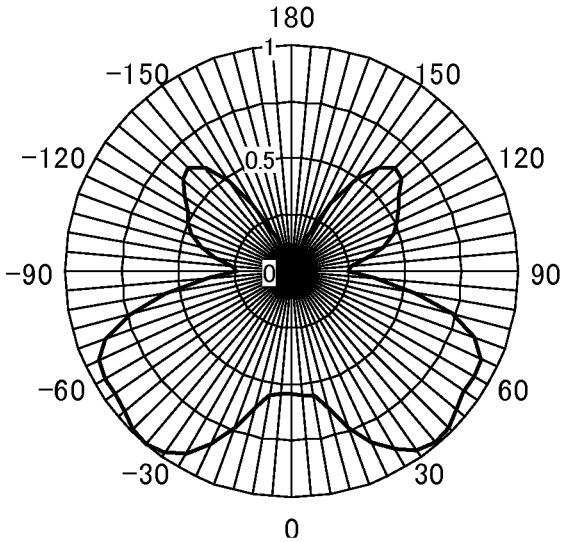
FIG. 9B is a graph of omnidirectional luminous intensity expressed in relative intensity of the light emitting device illustrated in FIG. 9A.

First, to describe the operation of the Fresnel lens part, the optical paths of light when using a substantially tabular first light flux controlling member are described. FIG. 8A is a drawing illustrating optical paths of light emitted from a light emitting element disposed outermost when using light flux controlling member 640 having a substantially tabular first light flux controlling member, and FIG. 8B is an enlarged view of a portion encircled by circle B in FIG. 8A. FIG. 9A is a partially sectional view of a light emitting device having light flux controlling member 640, and FIG. 9B is a graph of omnidirectional luminous intensity expressed in relative intensity of the light emitting device illustrated in FIG. 9A. The omnidirectional luminous intensity of the light emitting device is determined by simulation. The "luminous intensity" is substantially equal to the illuminance at a distance of 1,000 mm from light emitting element 130.

Figure 10A:
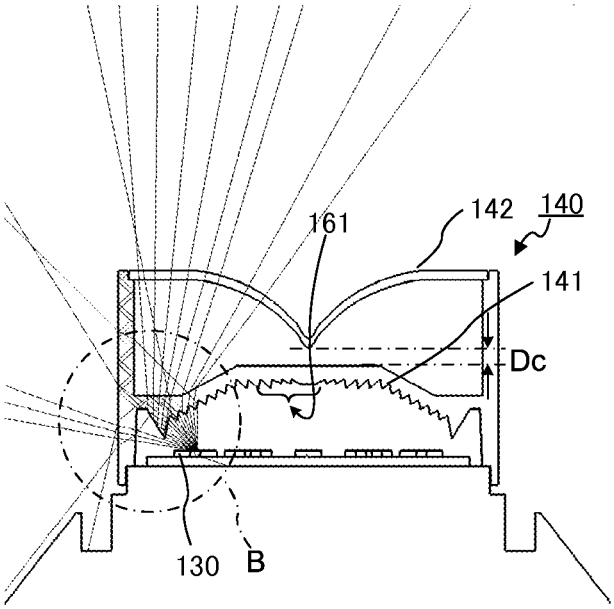
FIG. 10A is a drawing illustrating optical paths of light emitted from a light emitting element disposed outermost when using the light flux controlling member according to Embodiment 1.

Light flux controlling member 640 has the same components as those of light flux controlling member 140 except that light flux controlling member 640 has substantially tabular first light flux controlling member 641. When the distance in the direction of optical axis LA between the first light flux controlling member and a second light flux controlling member is set as Dc, Dc in light flux controlling member 640 is the same as Dc in light flux controlling member 140 (FIGS. 8A and 10A). The valleys in first light flux controlling member 641 are positioned at substantially the same planar surface, and emission surface 663 is formed on a planar surface. Therefore, the distance in the direction of optical axis LA between the valley and emission surface 663 is substantially constant.

As illustrated in FIG. 8B, when the optical axis of outermost light emitting element 130 is particularly set as LA', among the light beams emitted from light emitting element 130, light having an angle of 0° to $\theta_0$° relative to optical axis LA' directly enters first light flux controlling member 641 through first inclining surface 162*b*, in light flux controlling member 640. Light having an angle larger than $\theta_0$° relative to optical axis LA' of light emitting element 130 is transmitted through holder 150 to be emitted to the outside of light flux controlling member 140.

As illustrated in FIG. 9B, light flux controlling member 640 distributes light emitted from light emitting element 130 mainly obliquely forward (±60°) and obliquely backward (±120° to ±150°). However, there is less light distributed sideward (±90°).

Figure 10B:
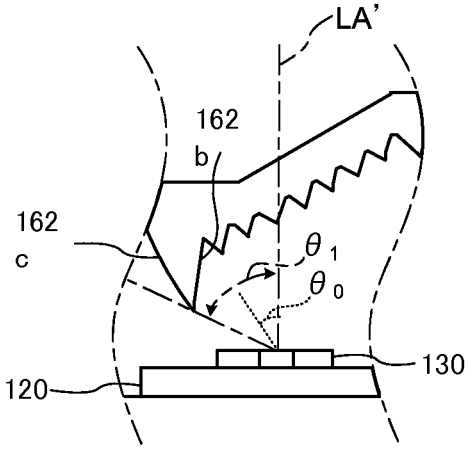
FIG. 10B is an enlarged view of a portion encircled by circle B in FIG. 10A of the light flux controlling member.
Figure 11A:
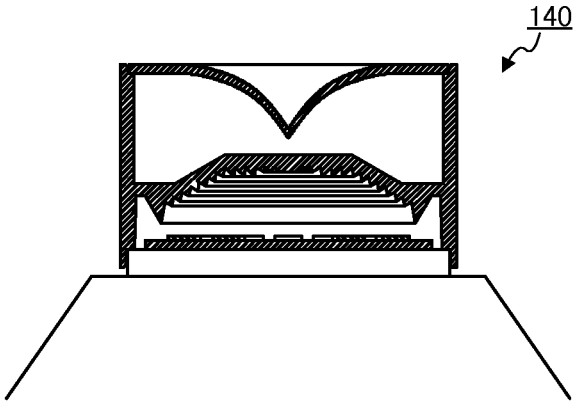
FIG. 11A is a partially sectional view of a light emitting device according to Embodiment 1.

Next, the optical paths of light when using first light flux controlling member 141 will be described. FIG. 10A is a drawing illustrating optical paths of light emitted from light emitting element 130 disposed outermost when using light flux controlling member 140, and FIG. 10B is an enlarged view of a portion encircled by circle B in FIG. 10A. FIG. 11A is a partially sectional view of a light emitting device having light flux controlling member 140, and FIG. 11B is a graph of omnidirectional luminous intensity expressed in relative intensity of the light emitting device illustrated in FIG. 11A.

As illustrated in FIG. 10B, among the light beams emitted from light emitting element 130, light having an angle of 0° to $\theta_1$° relative to optical axis LA' directly enters first light flux controlling member 141 through first inclining surface 162*b*. Since first light flux controlling member 141 includes inclining Fresnel lens part 162*d*, as illustrated in FIG. 10A, the distance from the apex of annular projection 162 disposed outermost to substrate 120 is shorter than that in the light emitting device illustrated in FIGS. 8A, 8B and 9A. Therefore, $\theta_1$ is larger than $\theta_0$. That is, in the light emitting device illustrated in FIGS. 10A, 10B and 11A, the distribution of light having an angle of 0 to $\theta_1$° larger than an angle of 0 to $\theta_0$° relative to optical axis LA' is substantially controlled by both first light flux controlling member 141 and second light flux controlling member 142.

Figure 11B:
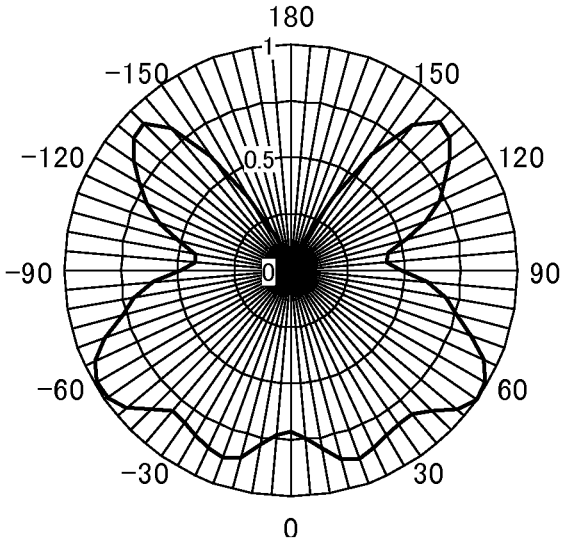
FIG. 11B is a graph of omnidirectional luminous intensity expressed in relative intensity of the light emitting device illustrated in FIG. 11A.

As illustrated in FIG. 11B, light flux controlling member 140 distributes light emitted from light emitting element 130 mainly obliquely forward (±15° and ±60°) and obliquely backward (±120° to ±150°). Further, there is more percentage of light distributed forward (0°) and sideward (±90°) compared to light flux controlling member 640. Thus, light flux controlling member 140 distributes light emitted from light emitting element 130 forward, sideward and backward in a well-balanced manner.

[Effect]

First light flux controlling member 141 is formed to have such a shape as to incline toward light emitting element 130 (downward), toward the rim portion of Fresnel lens part 162 away from refraction part 161 formed at the center portion. Thus, it is possible to reduce the amount of light that does not enter first light flux controlling member 141 but leaks from light flux controlling member 140. Therefore, light flux controlling member 140 can distribute light emitted from light emitting element 130 in the respective directions of forward, sideward and backward in a well-balanced manner. Accordingly, the light emitting device including light emitting element 130 and light flux controlling member 140 enables well-balanced light distribution characteristics to be achieved.

Furthermore, by allowing emitted light from light flux controlling member 140 to pass through cover 160, the amount of the emitted light in the respective directions of forward, sideward and backward through cover 160 is made to be more equal. Therefore, illumination apparatus 100 makes it possible to achieve the light distribution characteristics close to those of an incandescent lamp. Illumination apparatus 100 may be used for interior illumination or the like in place of an incandescent lamp.

In addition, illumination apparatus 100 can save the power consumption as compared with incandescent lamps, and can be used for a longer period of time than incandescent lamps.

Further, since first light flux controlling member 141 has a Fresnel lens structure, the thickness of first light flux controlling member 141 becomes smaller. Therefore, it becomes possible to further reduce the size of light flux controlling member 140.

[Modification]

Figure 12A:
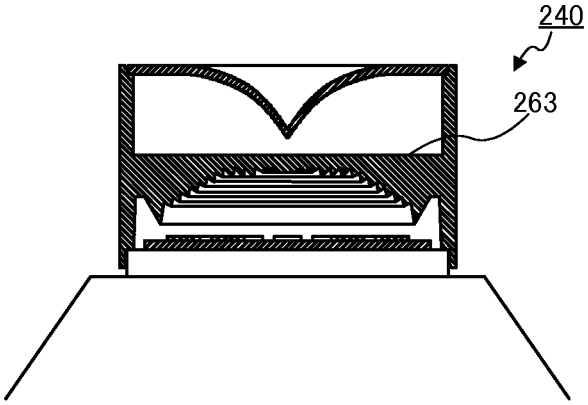
FIG. 12A is a partially sectional view of a light emitting device according to Embodiment 2.
Figure 12B:
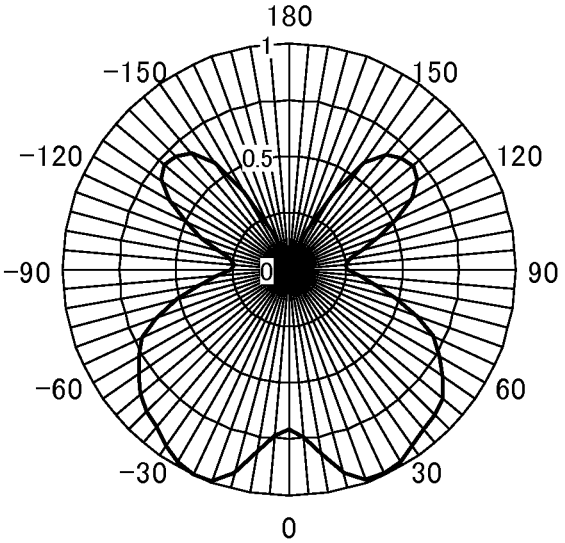
FIG. 12B is a graph of omnidirectional luminous intensity expressed in relative intensity of the light emitting device illustrated in FIG. 12A.

In light flux controlling member 140, emission surface 163 has inclining emission surface 163*b* correspondingly to inclining Fresnel lens part 162. In the present invention, as illustrated in FIG. 12A, the emission surface may be a planar surface. FIG. 12A is a partially sectional view of a light emitting device having light flux controlling member 240, and FIG. 12B is a graph of omnidirectional luminous intensity expressed in relative intensity of the above light emitting device. Light flux controlling member 240 has the same components as those of light flux controlling member 140 except that emission surface 263 is flat.

As illustrated in FIG. 12B, light flux controlling member 240 distributes light emitted from light emitting element 130 mainly obliquely forward (±15° to ±30°) and obliquely backward (±120° to ±150°). Further, compared with light flux controlling member 640, there is less light distributed obliquely forward (±60°), while there is more light distributed forward (0°). Thus, light flux controlling member 240 distributes light emitted from light emitting element 130 forward and backward in a well-balanced manner.

Figure 13A:
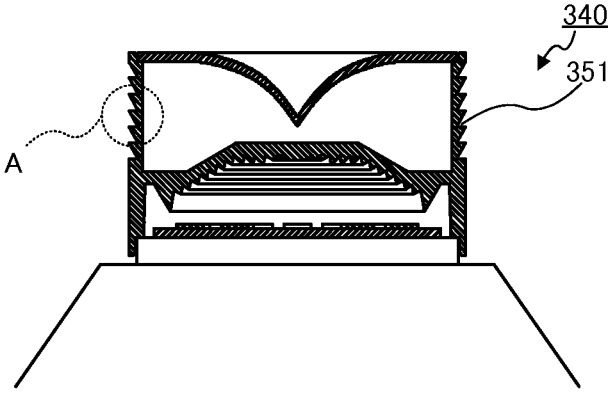
FIG. 13A is a partially sectional view of a light emitting device according to Embodiment 3.
Figure 13B:
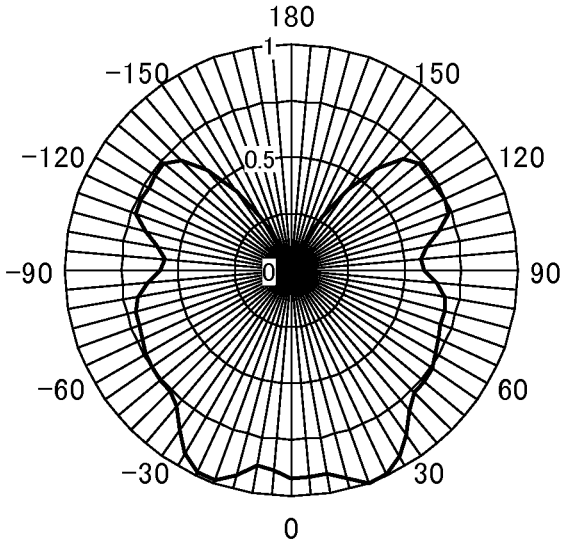
FIG. 13B is a graph of omnidirectional luminous intensity expressed in relative intensity of the light emitting device illustrated in FIG. 13A.
Figure 14A:
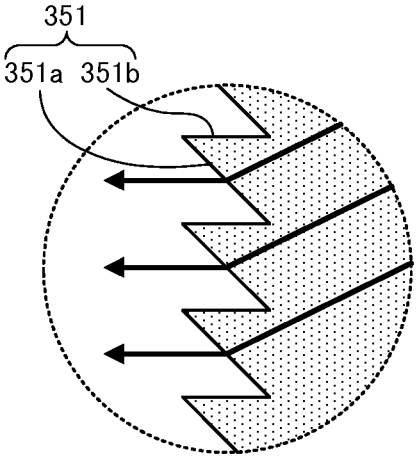
FIG. 14A is an enlarged view of a portion encircled by circle A in FIG. 13A of the light emitting device.
Figure 14B:
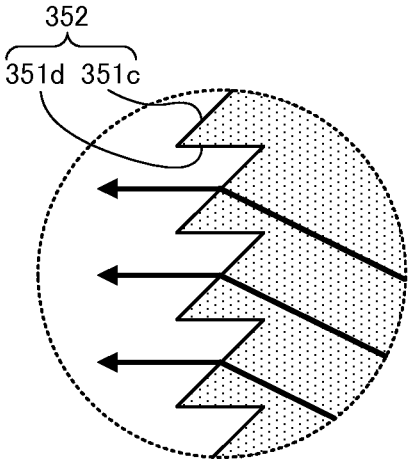
FIG. 14B is a drawing illustrating a modification of the portion illustrated in FIG. 14A.

Further, in light flux controlling member 140, the surface of holder 150 is smooth. As illustrated in FIGS. 13A and 13B, in the present invention, the surface of holder 150 may have irregularities that control the distribution of light to be transmitted through holder 150. FIG. 13A is a partially sectional view of a light emitting device having light flux controlling member 340, and FIG. 13B is a graph of omnidirectional luminous intensity expressed in relative intensity of the above light emitting device. FIG. 14A is an enlarged view of a portion encircled by circle A in FIG. 13A of irregularities formed on holder 150, and FIG. 14B is an enlarged view of a portion encircled by circle A in FIG. 13A of irregularities of another shape formed on holder 150. Light flux controlling member 340 has the same components as those of light flux controlling member 140 except that a plurality of recesses 351 are formed at a portion between first light flux controlling member 141 and second light flux controlling member 142 on the outer peripheral surface of holder 150.

A plurality of recesses 351 have the same shape and are disposed at constant intervals. The shape of recess 351 is rotationally symmetrical about the central axis (e.g., central axis CA1 or CA2) of holder 150 as a central axis. The sectional shape of recess 351 in the cross-section including the central axis of holder 150 is right triangle. As illustrated in FIG. 14A, recess 351 has inclining surface 351*a* at which the outer diameter of holder 150 is gradually decreased downward, and circular planar surface 351*b* which extends outwardly from the end of inclining surface 351*a* on first light flux controlling member 141 side and is orthogonal to the central axis of holder 150. Inclining surface 351*a* converts the traveling direction of light having been reflected at second light flux controlling member 142 and having reached holder 150 from second light flux controlling member 142 side (upper side) to be close to the direction orthogonal to optical axis LA of light emitting element 130 (sideward direction).

As illustrated in FIG. 13B, light flux controlling member 340 distributes light emitted from light emitting element 130 obliquely forward (±15°), sideward (±90°) and obliquely backward (±120° to ±150°). Further, compared with light flux controlling member 640, there is less light distributed obliquely forward (±60°), while there is more light distributed forward (0°), obliquely forward (±15°), sideward (±90°) and obliquely backward (±120° to ±150°). Thus, light flux controlling member 340 distributes light emitted from light emitting element 130 forward, sideward and backward in a well-balanced manner.

It is noted that the recess may be recess 352 as illustrated in FIG. 14B. Recess 352 has inclining surface 351*c* at which the outer diameter of second light flux controlling member 142 is gradually decreased upward, and planar surface 351*d* which extends outwardly from the end of inclining surface 351*c* on first light flux controlling member 141 side and is orthogonal to the central axis of holder 150. In this case, recess 352 converts the traveling direction of light having reached holder 150 from first light flux controlling member 141 side (lower side) to be close to the direction orthogonal to optical axis LA of light emitting element 130 (sideward direction).

Further, the shape of the recess is not particularly limited as long as the recess has a surface such as inclining surface 351*a* or 351*c* that converts the traveling direction of light from above or from under to be close to sideward direction. Such a surface also includes a surface of which generatrix line is a curve.

Figure 15A:
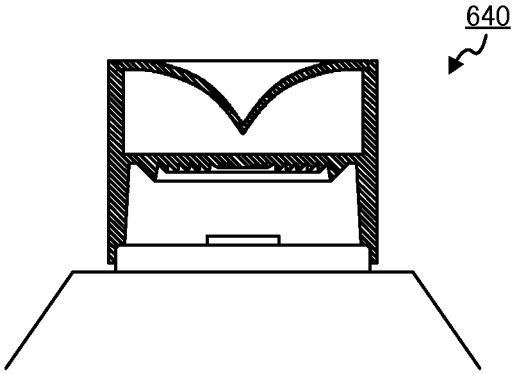
FIG. 15A is a partially sectional view of a light emitting device having a substantially tabular light flux controlling member and one light emitting element.
Figure 15B:
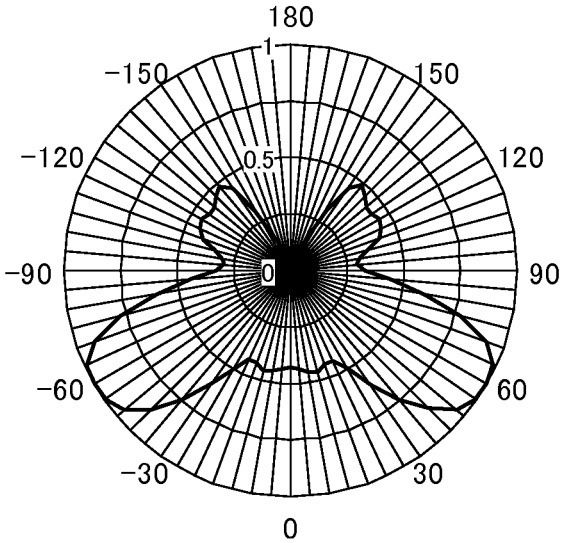
FIG. 15B is a graph of omnidirectional luminous intensity expressed in relative intensity of the light emitting device illustrated in FIG. 15A.
Figure 16A:
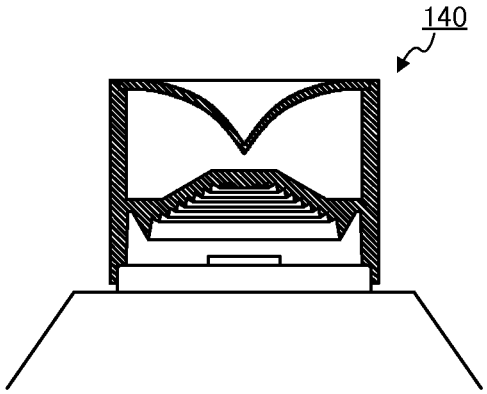
FIG. 16A is a partially sectional view of a light emitting device having the light flux controlling member according to Embodiment 1 and one light emitting element.
Figure 16B:
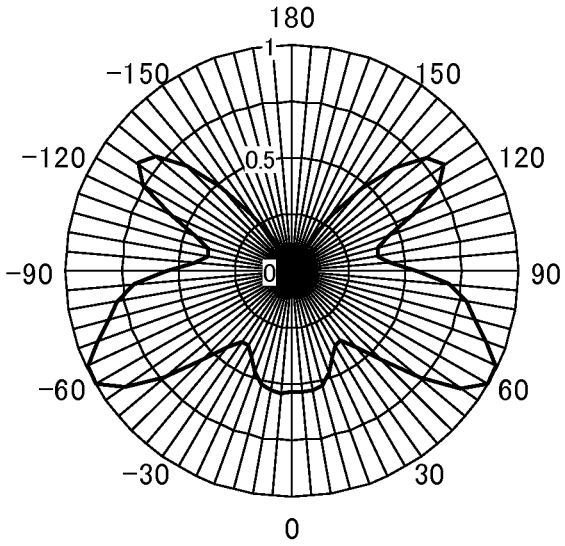
FIG. 16B is a graph of omnidirectional luminous intensity expressed in relative intensity of the light emitting device illustrated in FIG. 16A.
Figure 17A:
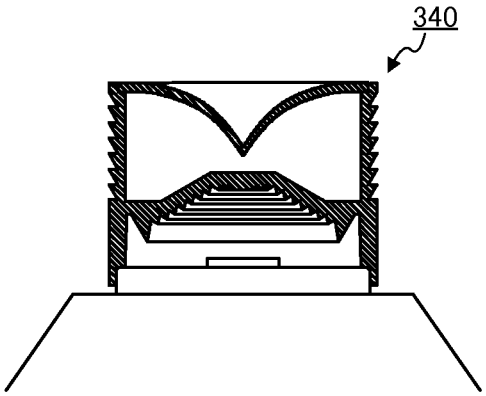
FIG. 17A is a partially sectional view of a light emitting device having the light flux controlling member according to Embodiment 3 and one light emitting element.

Furthermore, in the present invention, the number of light emitting element 130 may be one. FIG. 15A is a partially sectional view of a light emitting device having light flux controlling member 640 and one light emitting element 130, and FIG. 15B is a graph of omnidirectional luminous intensity expressed in relative intensity of the light emitting device illustrated in FIG. 15A. FIG. 16A is a partially sectional view of a light emitting device having light flux controlling member 140 and one light emitting element 130, and FIG. 16B is a graph of omnidirectional luminous intensity expressed in relative intensity of light emitting device illustrated in FIG. 16A. FIG. 17A is a partially sectional view of a light emitting device having light flux controlling member 340 and one light emitting element 130, and FIG. 17B is a graph of omnidirectional luminous intensity expressed in relative intensity of the light emitting device illustrated in FIG. 17A.

As illustrated in FIG. 15B, light flux controlling member 640 distributes light emitted from light emitting element 130 obliquely forward (±60°) and obliquely backward (±120° to ±150°), even when the number of light emitting element 130 is one.

As illustrated in FIG. 16B, light flux controlling member 140 distributes light emitted from light emitting element 130 obliquely forward (±60°) and obliquely backward (±120° to ±150°), even when the number of light emitting element 130 is one. Further, compared with light flux controlling member 640, there is more light distributed forward) (0°), sideward (±90°) and obliquely backward (±120° to ±150°). Thus, light flux controlling member 140 distributes light emitted from light emitting element 130 forward, sideward and backward in a well-balanced manner.

Figure 17B:
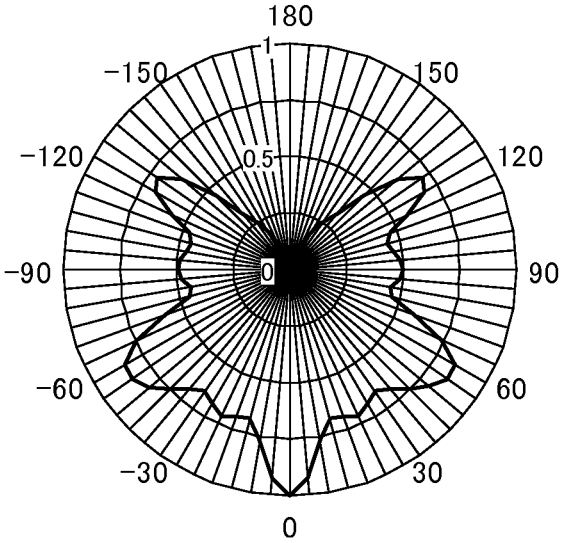
FIG. 17B is a graph of omnidirectional luminous intensity expressed in relative intensity of the light emitting device illustrated in FIG. 17A.

Further, as illustrated in FIG. 17B, light flux controlling member 340 distributes light emitted from light emitting element 130 obliquely forward (±30° and ±60°), sideward (±90°) and obliquely backward (±120° to ±150°), even when the number of light emitting element 130 is one. Further, compared with light flux controlling member 640, there is less light distributed obliquely forward (±60°), while there is more light distributed forward (0°), obliquely forward (0° to ±30°), sideward (±90°) and obliquely backward (±120° to ±150°). Thus, light flux controlling member 340 distributes light emitted from light emitting element 130 forward, sideward and backward in a well-balanced manner.

It is noted that the tip of outermost annular projection 162*a* of inclining Fresnel lens part 162*d* may be closer to substrate 120. For example, it is possible to bring the tip close to substrate 120 to a position at which $\theta_1$ in FIG. 10B is 90°. In this case, it is possible to further increase the amount of light that enters first light flux controlling member 141, and thus it is expected that light distribution is controlled more strongly by first light flux controlling member 141 and second light flux controlling member 142.

EXAMPLES

The illuminance of the light emitting device according to the present invention was measured. The intersection between optical axis LA and the surface of substrate 120 was set as a luminescence center, and the illuminance at a point 1,000 mm distant from this luminescence center was measured. Light flux controlling members 140 and 340 are employed as the light flux controlling member. Further, as a reference example, a light emitting device having light flux controlling member 640 is used to measure illuminance in the same manner. The measurement results are illustrated in FIGS. 18A and 18B.

Figure 18A:
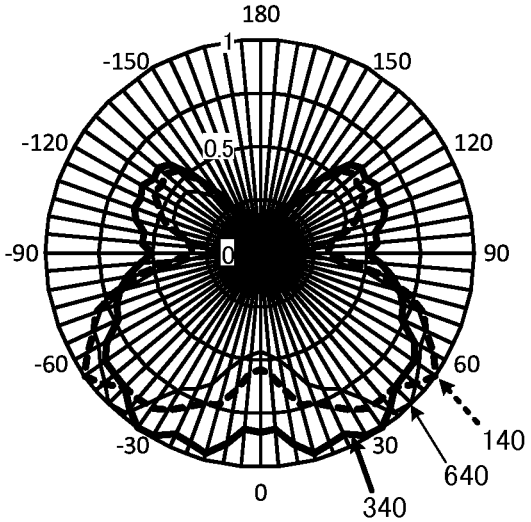
FIG. 18A is a graph of omnidirectional luminous intensity expressed in relative intensity of an illumination apparatus provided with a second light flux controlling member having a light transmittance of 21%.

FIG. 18A is a graph of omnidirectional luminous intensity expressed in relative intensity of a light emitting device provided with white second light flux controlling member 142 having a light transmittance of 21%. FIG. 18B is a graph of omnidirectional luminous intensity expressed in relative intensity of a light emitting device provided with white second light flux controlling member 142 having a light transmittance of 13%. In FIGS. 18A and 18B, a thick broken line, a thick solid line, and a thin solid line mean illuminance of light emitting devices provided with light flux controlling members 140, 340, and 640, respectively.

Figure 18B:
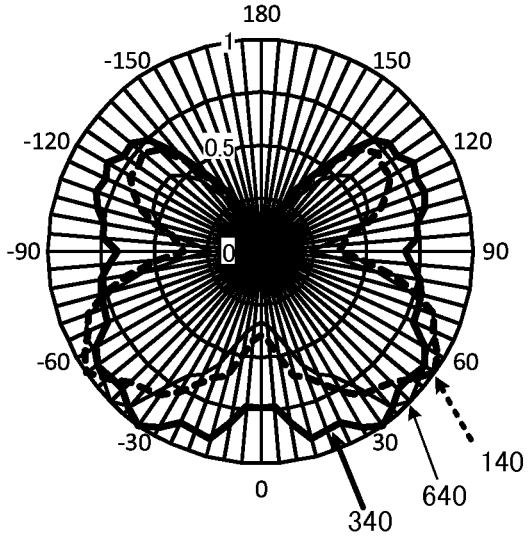
FIG. 18B is a graph of omnidirectional luminous intensity expressed in relative intensity of an illumination apparatus provided with a second light flux controlling member having a light transmittance of 13%.

As is obvious from FIGS. 18A and 18B, when light distribution characteristics of the illuminance of the light emitting device were measured, the light distribution characteristics with the same tendency as the luminous intensity obtained by the above-described simulation were obtained. In addition, it can be found that higher light reflectance (lower light transmittance) of the second light flux controlling member is effective for increasing the amount of light sideward (±90°) and obliquely backward (±120° to ±150°.

The disclosure of Japanese Patent Applications No. 2012-223224 filed on Oct. 5, 2012 including the specification, drawings and abstract is incorporated herein by reference in its entirety.

INDUSTRIAL APPLICABILITY

The illumination apparatus according to the present invention may be used in place of an incandescent lamp, and may be therefore widely applicable to various kinds of lighting equipment such as chandeliers and indirect illumination apparatuses.

REFERENCE SIGNS LIST

10, 100 Illumination apparatus
12 LED
14 Case

16 Aluminum plate
18 Transmission window
20 Cover
110 Casing
110*a* Inclining surface
110*b* Base
120 Substrate
130 Light emitting element
140, 240, 340, 640 Light flux controlling member
141, 641 First light flux controlling member
142 Second light flux controlling member
145 Reflection surface
148 Flange part
150 Holder
151 Lower step part
160 Cover
161 Refraction part
162 Fresnel lens part
162*a* Annular projection
162*b* First inclining surface
162*c* Second inclining surface
162*d* Inclining Fresnel lens part
163, 263, 663 Emission surface
163*a* Circular emission surface
163*b* Inclining emission surface
163*c* Annular emission surface
351, 352 Recess
351*a*, 351*c* Inclining surface
351*b*, 351*d* Planar surface
CA1, CA2 Central axis
LA Optical axis

The invention claimed is:

1. A light flux controlling member for controlling a distribution of light emitted from at least one light emitting element, the light flux controlling member comprising:

a first light flux controlling member disposed to face the light emitting element; and a second light flux controlling member disposed to face the first light flux controlling member, wherein:

the first light flux controlling member includes a Fresnel lens part that has a plurality of rotationally symmetrical annular projections about an optical axis of the light emitting element as a rotation axis and faces the light emitting element, and an emission surface that faces the second light flux controlling member to emit light controlled by the Fresnel lens part toward the second light flux controlling member, each of the annular projections has an inner first inclining surface configured to receive a part of the light emitted from the light emitting element, and an outer second inclining surface for reflecting a part of the light having entered the first inclining surface toward the second light flux controlling member, the second light flux controlling member includes a reflection surface that faces the emission surface of the first light flux controlling member to reflect a part of light emitted from the first light flux controlling member and reached the second light flux controlling member, and to transmit a rest of the light, the reflection surface is a rotationally symmetrical plane about the optical axis as a rotation axis, the rotationally symmetrical plane having a generatrix line that is a concave curve relative to the first light flux controlling member, an outer peripheral portion of the reflection surface is located at a position distant from the light emitting element in a direction of the optical axis compared with a center portion of the reflection surface, and the Fresnel lens part includes an inclining Fresnel lens part at which a distance in the direction of the optical axis from a valley formed between the adjacent annular projections to a mounting surface on which the light emitting element is to be mounted is gradually increased toward the optical axis away from an outside.

2. The light flux controlling member according to claim 1, wherein the emission surface includes an inclining emission surface at which a distance in the direction of the optical axis from the inclining emission surface to the mounting surface is gradually increased toward the optical axis.

3. A light emitting device comprising:

at least one light emitting element; and the light flux controlling member according to claim 1.

4. An illumination apparatus comprising:

the light emitting device according to claim 3; and a cover for transmitting light emitted from the light emitting device while diffusing the emitted light.

* * * * *